United States Patent [19]

Jores

[11] 4,175,713

[45] Nov. 27, 1979

[54] CONTINUOUSLY OPERATING AUTOMATIC STRIP WINDING DEVICE

[75] Inventor: Willi Jöres, Leverkusen, Fed. Rep. of Germany

[73] Assignee: AGFA-Gevaert, Aktiengesellschaft, Leverkusen, Fed. Rep. of Germany

[21] Appl. No.: 914,053

[22] Filed: Jun. 9, 1978

[30] Foreign Application Priority Data

Jun. 15, 1977 [DE] Fed. Rep. of Germany ..... 2726856

[51] Int. Cl.[2] ..... B65H 19/26; B65H 19/30

[52] U.S. Cl. ..... 242/56 R; 242/76; 242/81

[58] Field of Search ..... 242/56 R, 56 A, 78.1, 242/80, 81, 79, 67.1 R, 25 A, 56.2, 56.4, 56.6, 76, 67.2, 67.3 R, 56.9

[56] References Cited

U.S. PATENT DOCUMENTS

| | | | |
|---|---|---|---|
| 1,065,681 | 6/1913 | Harbeck | 242/56 R |
| 2,006,499 | 7/1935 | Fourness et al. | 242/56 R |
| 2,449,234 | 9/1948 | Knoble | 242/56 R |
| 3,501,104 | 3/1970 | Hellemans | 242/56 A |
| 3,776,481 | 12/1973 | Ichikawa | 242/56 A |
| 3,777,998 | 12/1973 | Jores et al. | 242/56.2 |
| 3,796,389 | 3/1974 | Nishiyori et al. | 242/78.1 X |
| 3,917,181 | 11/1975 | Zajac | 242/18 R |
| 3,921,929 | 11/1975 | Jores et al. | 242/76 |

*Primary Examiner*—Harvey C. Hornsby
*Assistant Examiner*—John M. Jillions
*Attorney, Agent, or Firm*—Connolly and Hutz

[57] ABSTRACT

The present invention relates to an automatic strip-winding device for winding a plurality of narrow strips cut from a wide web without stopping the continuously running wide web whereby the threading device has a first position in which winding on to the first head initially takes place, a second position in which winding on the second head initially takes place and a central position in which the major part of the winding of each head takes place, the threading device being adapted to pivot from the central position to the first or second position when winding on the second or first head respectively is almost complete. The device has a conveyor for receiving completed rolls from the winding heads after they have pivoted through 180° and means for feeding fresh winding tubes to the winding heads.

4 Claims, 5 Drawing Figures

CONTINUOUSLY OPERATING AUTOMATIC STRIP WINDING DEVICE

The invention relates to an automatic strip-winding device for winding a plurality of narrow strips cut from a wide web without stopping the continuously running wide web.

Automatic strip-winding devices are required if several strips or webs are to be wound simultaneously into rolls having a specific final diameter. The basic components of these machines are rotary winding heads. Threading devices are arranged in front of the winding heads and supply the strips to spool cores or winding tubes mounted on the winding heads. Cutting blades which cut the strips when the roll or winding has reached the desired diameter are arranged in the region of the threading devices. Devices for starting winding ensure that the first convolution on the spool core or on the winding tube is wound correctly. A length compensator is provided in the strip guide so that the strips travel along the same paths until they are wound up. A unit for turning the strip moves the rotation of the strips from the horizontal plane into the vertical plane. The ready-wound rolls are finally deposited on a conveyor belt and carried off.

Roll-cutting and winding machines are known in which the cut strips are wound on two horizontal spindles arranged above one another and provided with cardboard tubes. The arrangement of these spindles has the disadvantage that the set-up time for fitting the spindles is very long and thus the machine is standing while the rolls are being changed for a longer period than it actually runs. An additional problem is that the individual strips have to be stuck to the cardboard tubes with adhesive tape at the beginning of the winding operation. Furthermore, when starting to wind the rolls of paper, it is necessary to check that the strips are wound on with equal edges, and the strips have to be cut off the completed roll manually and the roll has to be removed manually so the individual roll has to be slid over the spindle.

Automatic devices for roll-cutting and winding are known in which the cardboard tubes are automatically deposited, the strips automatically stuck, the rolls automatically completely wound and cut off. However, these machines are not suitable for winding sensitive types of paper, for example, photographic paper, as they use hot glue for sticking the strips to the cardboard tubes.

Other roll-cutting and winding machines are produced which operate by means of drive or contact rollers. In this case, the cardboard tubes are taken up without the use of spindles on two pendulum arms and are driven via contact rollers. It is easy to see that this method is also unsuitable for winding strips having sensitive surfaces. The drive of the contact rollers would certainly cause scratches and damages to the surface.

A tandem automatic winding device is described in a patent application, Germal Offenlegunsschrift No. 2 165 525, which uses two winding units. While one unit winds, the wound roll is removed or deposited by the second unit and a new winding tube applied. The standing periods of the machine are thus reduced but the machine still has to be slowed down and stopped for changing the units.

A strip-winding apparatus is described and claimed In U.S. Pat. No. 3,501,104 which operates continuously but only winds one web in the process. A multiplication of this device for ten or more winding units is not technically feasible owing to the enormous expense. In addition, it is necessary to carry out removal of the wound roll and insertion of a new tube for winding the strip manually or mechanically.

Automatic winding devices for a plurality of strips which operate completely automatically and continuously are not yet known.

According to the invention there is provided an automatic strip-winding device for winding a plurality of strips or narrow webs cut from a web into rolls, comprised of a threading device which is pivotal in a horizontal plane and is provided with a rotary cutting device for cutting the web when a roll is complete, first and second winding heads adapted to receive webs from the threading device and each pivotal through 180° in a vertical plane, the threading device having a first position in which winding on to the first head initially takes place, a second position in which winding on to the second head initially takes place, and a central position in which the major part of the winding of each head takes place, the threading device being adapted to pivot from the central position to the first or second position when winding on the second or first head respectively is almost complete, a conveyor for receiving completed rolls from the winding heads after they have pivoted through 180°, and means for feeding fresh winding tubes to the winding heads.

The device according to the invention treats the product to be wound, such as for example a photographic film or paper, carefully, and produces automatically and accurately wound rolls of strip material continuously without the wide web of material stopping or being braked and conveys them for further packaging. An embodiment of the device is capable of working with various cutting widths for the narrow strips. Auxiliary work can be reduced to a minimum, up to refilling of the magazine.

Preferably the winding heads were provided with new winding tubes after depositing the wound rolls on to a belt, by an operation in which the winding heads automatically receive winding tubes removed by a pair of tube tongs from a tube magazine and from the subsequent channel and fed beneath the winding head in such a way that the belt with the positioned tubes and tube tongs is lifted vertically towards winding heads and thus slides the winding tubes on to the winding heads.

The winding power of the automatic strip-winding device is preferably further increased by having the ends of the completely wound roll held on the circumference of the complete roll by means of at least one and preferably a plurality of pressure rollers lying against the roll under spring bias, so that it may be pivoted about 180° into the depositing position after cutting of the strip, even in the case of a finished roll which is being removed.

In addition, the winding heads of the automatic strip winding device are each preferably driven by a controllable winding motor without intermediate mechanical components.

The individual mechanical components of the automatic strip-winding device such as the drive rollers and guide rollers, the automatic threading device with the cutting device, the sleeves for starting winding, the winding head and the tube tongs and magazine are preferably designed so that several widths of strip may be wound.

One advantage of this invention is its high winding capacity which is 300% greater than in a normal roll cutter and up to 40% more than the fastest of the designs described above. Another advantage of the invention is the careful treatment of the strip so that even the most sensitive surface, for example photographic films and papers, may be wound. Another advantage is the qualitatively preferable form of the roll with regard to firmness between the convolutions and the fit on the tube, the flush connection of the surface of the roll with the tube, and the initial winding effected without sticking the strip to the tube which is, for example, of considerable importance when producing photographs with high speed printers.

Another advantage is that the machine need not be restricted to one specific width of strip to be wound but can within limits wind several widths (for example from 7.6 cm to 13.8 cm) without substantial adjustments. The automatic strip winding device can be placed downstream of any commercial high speed strip-cutting machine. The winding tubes are applied automatically so that one or at most two people are required for operating the machine.

An embodiment of the invention is shown in the accompanying drawings, in which.

Figure 2:
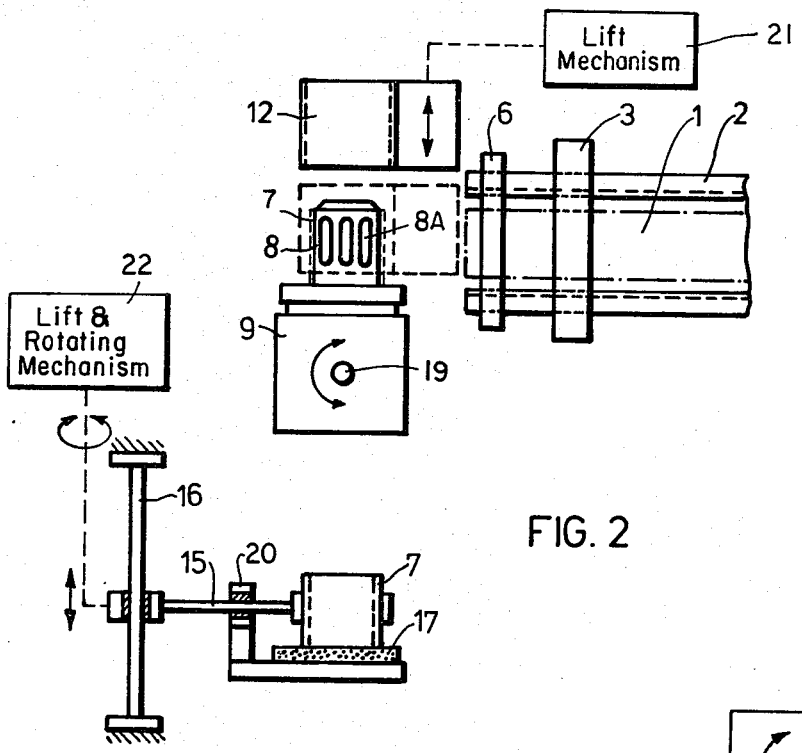
FIG. 2 is a side view of a winding unit in the winding position with a lowered strip.

A paper, film, plastics or other strip 1 to be wound comes from a known strip cutting machine (not shown) via guiding rollers to a preferred roller section 5 and is inserted into an automatic threading device 2 by means of a pressure roller 6. The threading device 2 guides the strip 1 into a sleeve 12 as shown at station A which starts the winding operation and leads the strip round a winding head 8 with a tube 7 and forms the roll with a pressure roller 18 pivoted at the sleeve 12 and pressed against the winding tube 7 by means of a spring to conduct the beginning of the strip 1 under the strip 1 of the second turn. After the formation of a few convolutions of the strip 1 round the tube 7, the roll is firmly wound on, and the sleeve 12 is not necessary for continuing winding and is moved upwards vertically over the winding head 8 by a lift mechanism 21 as shown in FIG. 2. As the roll 10 is being wound, the automatic threader 2 is pivoted by the drive mechanism 4 into a position between A and B and thus continues to wind the roll so that the strip 1 runs over the pressure roller 6.

In the meantime, the unit B is in the ready position. The automatic threader now pivots to unit B but the strip is still wound on unit A. Once the desired adjustable number of meters has been wound on Unit A, a cutting device 3 operates to cut the strip on unit A by means of rotating transverse blades and simultaneously threads the subsequent strip into unit B in the same manner as that described for unit A which in turn winds the next roll 10.

Figure 3:
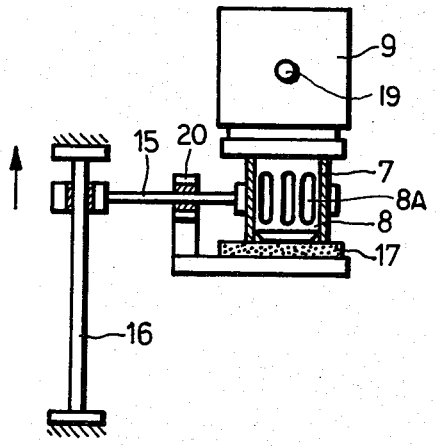
FIG. 3 is a similar side view to that of FIG. 2 but with a spindle pivoted downwards, a raised strip and the tube holder
Figure 4:
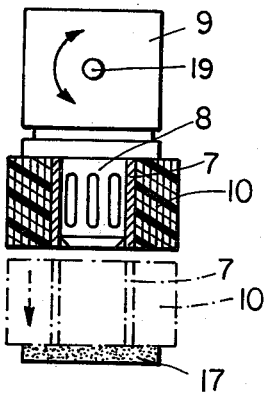
FIG. 4 is a side view of the winding head and finished roll pivoted to the roll delivery position.

The end of the strip 1 is held by pressure rollers 11 which are in rolling contact with the circumference of the roll under spring tension and, even when the finished roll 10 is rolled off, the winding head 8 with the completed roll 10 holding together by means of the pressure rollers 11 is pivoted about 180° downwards into the delivery position around the shaft 19 of the winding motor 9 (FIGS. 2, 3 and 4). The completed roll 10 is separated from the winding head 8 by releasing a pneumatic 8A or other catch and it slides down from the winding head 8 on to a conveyor belt 17 as shown in FIG. 4, which is lifted by lift and rotating mechanism 22 against the completed roll 10 and then removes roll 10. Belt 17 goes down again with the roll and carries it out of the process.

Figures 1, 1A:
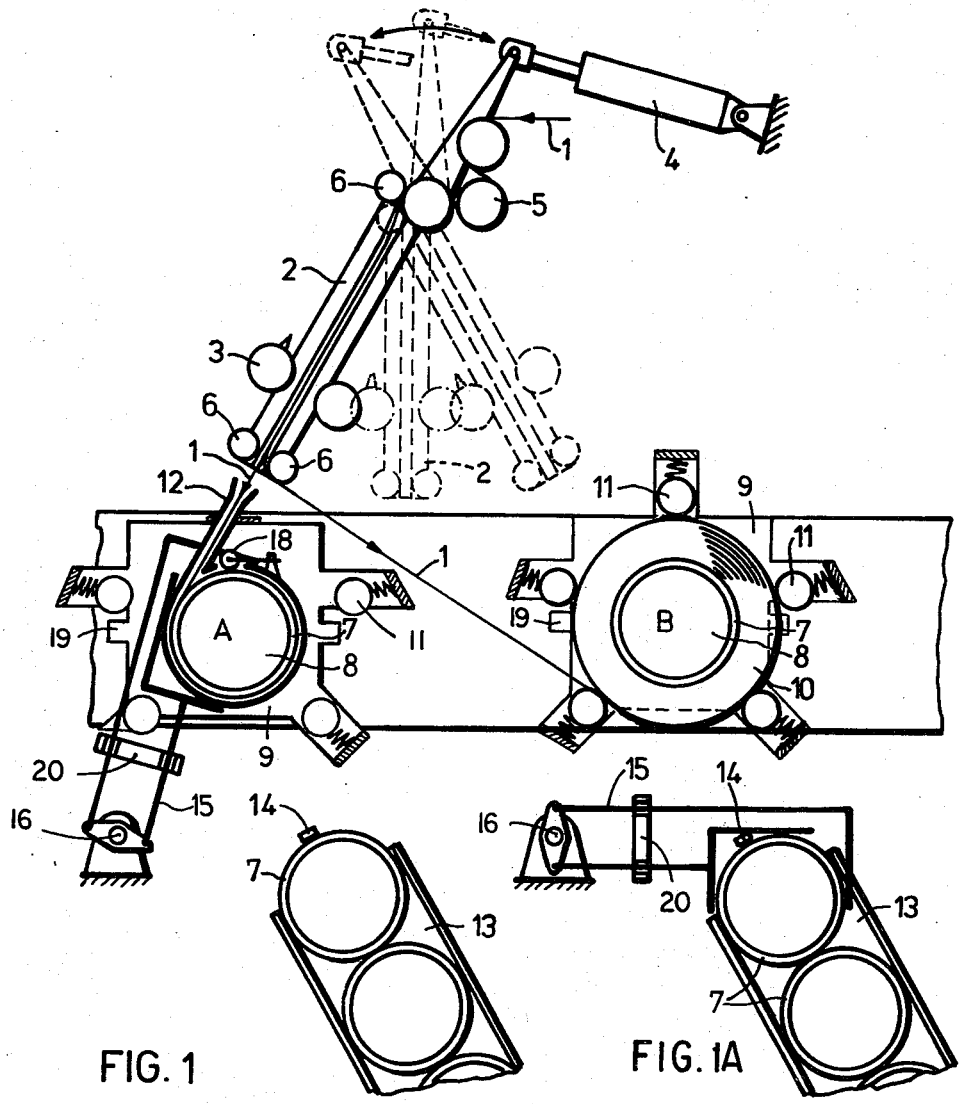
FIG. 1 is a top plan view of a threading device, the double winding units A and B and a device for inserting tubes of this invention.
FIG. 1A is a top plan view of the device for inserting tubes in the tube pick-up position.

In a winding tube magazine, winding tubes are delivered into a channel 13 from which the tube tongs 15 remove a winding tube, FIG. 1A after overcoming the force of a tube braking spring 14 and, position it beneath the winding head 8 on the conveyor belt 17 which is in the lower position on platform 20. By lifting the belt 17, the tube tongs 15 with platform 20 are guided on a tong guide shaft 16, and the winding tube 7 is slid over the winding head 8 as shown in FIG. 3. After opening the tube tongs, the tongs 15 and conveyor belt 17 supported on platform 20 are lowered by mechanism 22, the winding motor 9 again pivots 180° upwards with the winding head and is in the ready position for lowering the sleeve 12 for starting winding and then, once the auotmatic threading device 2 has pivoted in front of the sleeve 12 for starting winding, for effecting winding in unit A again when the desired number of meters has been wound in unit B.

I claim:

1. An automatic strip-winding device for continuously winding a plurality of strips into completed rolls comprising pivotal winding heads, winding starting devices for the strips and depositing devices for the completed rolls, characterized in that there is provided for each of the strips a pivotal threading device with a cutting device thereon and conducting and pressure rollers for supplying running lengths of the strips, two similar winding heads arranged side-by-side at stations A and B with winding motors, a winding starting sleeve at each of stations A and B, tube supply means for providing empty winding tubes to the winding heads, axial moving means on each of the sleeves for applying it over the winding heads and tube to start the winding means for pivoting the threading device between a first position at the first station to first conduct the strip into the sleeve to start it winding on the tube, a second central position between the first and second stations to allow winding the roll completely at the first or second and a third position at the second station shortly before completion of the winding on the winding head at the first station wherein after cutting the strip by means of the cutting device, the strip for the next roll is conducted into the sleeve at the second station to be wound up on the winding head, means to hold the completed roll together to fix the end of the strip on the circumference of the roll, the winding motors each being mounted on a pivot shaft, a conveyor belt disposed adjacent the first and second stations, means to pivot the winding heads approximately 180° around the shaft of the winding motor to bring a completed roll over the conveyor belt, lifting means connected to the conveyor belt for lifting it against the winding head carrying the completed roll to receive the roll and to lower and carry away the completed roll, the tube supply means including means to take up a new winding tube and apply it to the winding head, whereby after unloading the completed roll the winding head is pivoted approximately 180° C. to the winding and starting position again, the threading device is brought to the second central winding position for completing the winding at the second station and shortly before finishing the roll at the second station is brought to the first position to repeat the winding in an alternating manner.

2. An automatic strip-winding device according to claim 1, in which the tube supply means includes a tube magazine having a delivery channel and tube tongs mounted at the end of the delivery channel to take up one tube at a time to bring it to the winding head means to pivot the tube tongs over the conveyor belt beneath the winding head in its lower position, and means to vertically lift the conveyor belt together with the positioned tube tongs and the winding tube to push the winding tube onto the winding head.

3. An automatic strip-winding device according to claim 1 wherein said means to hold the completed roll together and to fix the end of the strip on the circumference comprises one or more pressure rollers disposed against the completed roll under spring bias.

4. An automatic strip winding device according to claim 1, characterized in that the individual winding heads are driven each by a controllable winding motor without intermediate mechanical components.

* * * * *